US005409271A

United States Patent [19]

Hoffmann

[11] Patent Number: 5,409,271

[45] Date of Patent: Apr. 25, 1995

[54] SAFETY LATCH FOR SLIDING DOOR LOCK PIN

[76] Inventor: John K. Hoffmann, 49 Peppercorn Ln., Palm Coast, Fla. 32137

[21] Appl. No.: 121,875

[22] Filed: Sep. 17, 1993

[51] Int. Cl.[6] ..... E05C 5/02

[52] U.S. Cl. ..... 292/62; 292/DIG. 46; 292/DIG. 47

[58] Field of Search ..... 292/57, 147, 288, DIG. 47, 292/346, DIG. 46, 145, DIG. 53, 349, DIG. 38

[56] References Cited

U.S. PATENT DOCUMENTS

| | | | |
|---|---|---|---|
| 1,907,625 | 5/1933 | Vogt | 292/DIG. 46 |
| 2,269,264 | 1/1942 | Haim | 292/62 |
| 3,094,861 | 6/1963 | Sayles | 70/95 |
| 3,397,000 | 8/1968 | Nakanishi | 292/62 |
| 3,490,802 | 1/1970 | Zeit | 292/145 |
| 3,709,539 | 1/1973 | Sodenkamp, Jr. | 292/145 |
| 3,768,847 | 10/1973 | Buch, Jr. et al. | 292/DIG. 46 |
| 3,779,588 | 12/1973 | Raymon | 292/57 |
| 3,792,883 | 2/1974 | Juarbe | 292/1 |
| 3,869,887 | 3/1975 | Zeit | 70/100 |
| 3,913,957 | 10/1975 | Astie et al. | 292/57 |
| 4,102,545 | 7/1978 | Jay | 292/57 |
| 4,138,150 | 2/1979 | Bills | 292/DIG. 47 |
| 4,345,448 | 8/1982 | Solomon | 70/95 |
| 4,635,976 | 1/1987 | Sigler | 292/57 |
| 4,690,441 | 9/1987 | Fazzolari et al. | 292/57 |
| 4,699,406 | 10/1987 | Swanson, Jr. | 292/DIG. 47 |
| 5,284,371 | 2/1994 | Richardson et al. | 292/DIG. 46 |

*Primary Examiner*—Peter M. Cuomo
*Assistant Examiner*—Monica E. Millner
*Attorney, Agent, or Firm*—Edward M. Livingston

[57] ABSTRACT

A latch-pin lock for sliding doors and windows has a latch (1) on a base plate (4) that is attachable to a sliding-door frame (5) adjacent to a sliding-door lock pin (7). The latch retains the sliding-door lock pin (7) in door lock-pin orifices (9) in opposition to vibrational manipulation of the door and door frame (5) generally applied by persons attempting unauthorized entry. The latch can be glued or otherwise fastened to the door frame (5) either after, before or during construction of a building to which the sliding door is attached. With either a pivotal or a sliding contact of the latch (1) with the base plate (4), the latch can be positioned on the lock pin (7) to retain the lock pin (7) in a locking or in an unlocking distance of entry into a lock-pin orifice (9) as desired.

6 Claims, 3 Drawing Sheets

FIG. 4
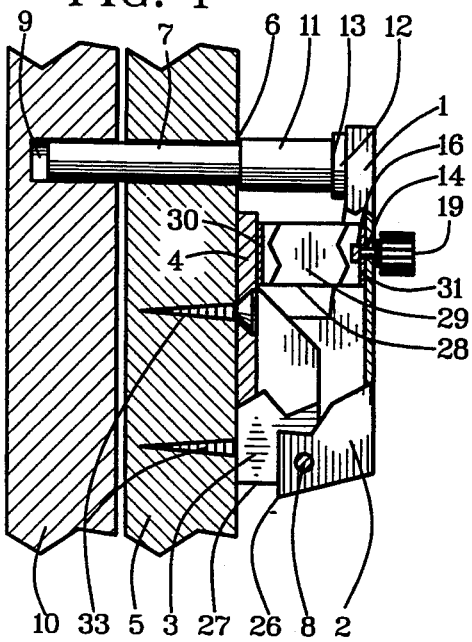
FIG. 5
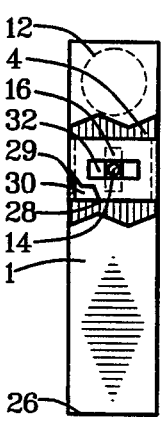
FIG. 6
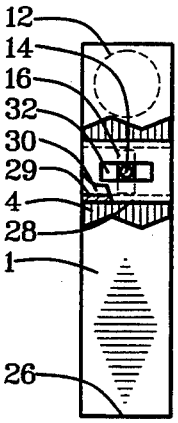
FIG. 7
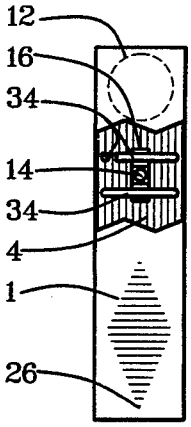
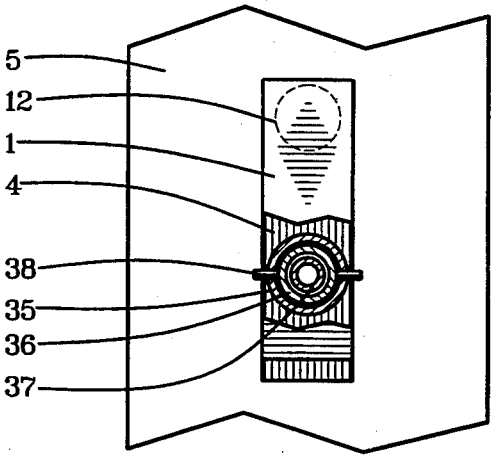
FIG. 9
FIG. 8
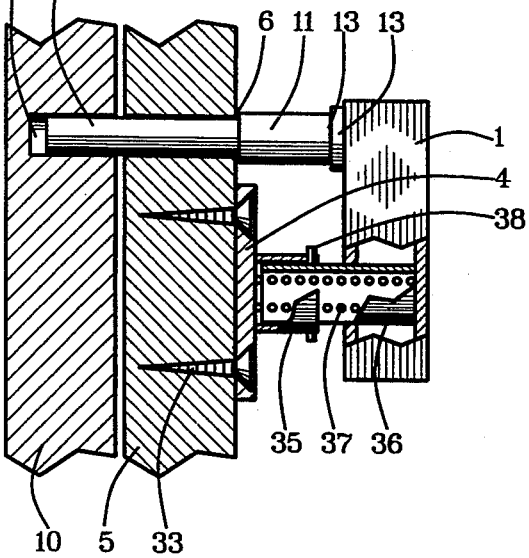
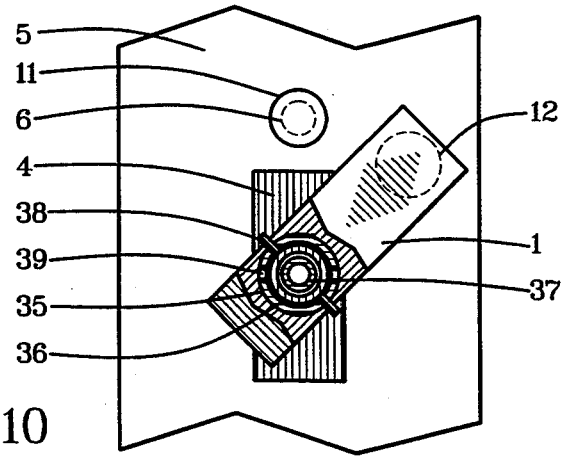
FIG. 10

SAFETY LATCH FOR SLIDING DOOR LOCK PIN

BACKGROUND OF THE INVENTION

This invention relates to lock pins for sliding doors and in particular to a retainer latch for preventing outside removal of lock pins from sliding doors.

A large portion of sliding doors are locked from within with a lock pin that extends into a second sliding door from a first door frame. Burglars can remove the lock pin by merely tapping or pounding the outside of the door often with cushioned impact to muffle noise and to increase a spring action of the impact. This causes the lock pin to travel horizontally out of a locking orifice in the door and thereby unlocks the sliding door. There is a wide selection of locks for lock pins available, but they are not used often by builders because they are too expensive and increase construction costs. Buyers of homes and other buildings usually are unaware of how easily an unlocked lock pin can be removed by burglars. The lock pin has the appearance of a dead-bolt lock and often provides a dangerous sense of security. Consequently, sliding doors without locks or latches for lock pins continue to be constructed and sold on a large part of dwellings and other buildings.

There is no known lock-pin latch that can be attached without modification of door frames of sliding doors either after or at the time of building construction to retain standard lock pins in place against outside tapping impact by burglars. Nor is there a known lockable lock pin that is sufficiently inexpensive that it is likely to be attached by builders or purchased by frugality-minded users and owners of buildings with un-lockable lock pins. Further yet, there is no known latch for such latch pins that can be attached so quickly and easily by users and owners of buildings that it is likely to be used. Even a renter of buildings with un-lockable lock pins on sliding doors is likely to use this invention.

Examples of different lockable pins for sliding doors can be found in U.S. Pat. Nos. 4,102,545, 4,345,448, 3,869,887, 3,709,539, and 3,490,802, but none are useable with existing non-lockable pins. None can be attached without modification of the sliding door or door frame. All are too different to describe for comparison of similarities to this invention.

SUMMARY OF THE INVENTION

In light of the problems that have existed and that continue to exist in this field, objectives of this invention are to provide a lock-pin latch which:

Can be attached to existing sliding-door flames or to sliding-door frames during construction of buildings without modification of the sliding-door frame;

Retains sliding-door lock pins in locked condition when pounded, jared, vibrated or otherwise manipulated in ways that cause present sliding-door lock pins to be disengaged from a locked condition by action of would-be burglars or others attempting unauthorized entry into a building through sliding doors;

Can be constructed and distributed broadly at a cost affordable to all owners and users of sliding doors through which unlawful entry is probable; and Can be attached quickly and easily by lay persons without professional or trade-person assistance.

This invention accomplishes the above and other objectives with a latch on a base plate that is attachable to a sliding-door frame adjacent to a sliding-door lock pin. The latch retains the sliding-door lock pin in frame lock-pin orifices in opposition to vibrational manipulation of the door and door frame generally applied by persons attempting unauthorized entry. The latch can be glued or otherwise fastened to the door frame either after, before or during construction of a building to which the sliding door is attached. With either a pivotal or a sliding contact of the latch with the base plate, the latch can be positioned to retain the lock pin in a locking or in an unlocking distance of entry into a lock-pin orifice as desired.

BRIEF DESCRIPTION OF THE DRAWINGS

This invention is described by appended claims in relation to description of a preferred embodiment with reference to the following drawings which are described briefly as follows:

FIG. 4 is the FIG. 1 illustration modified for use of a plate instead of a wire type of shaft-lock member that is used on the FIG. 1 illustration. It is modified also for fastener-screw attachment instead of adhesive attachment to a door frame;

FIG. 5 is a cutaway front view of the FIG. 4 illustration with a lock arm pivoted to a lock position and without attachment to a door frame;

FIG. 6 is the FIG. 5 illustration modified for use of a plate type of shaft-lock member attached perpendicularly instead of parallel to a base plate;

FIG. 7 is the FIG. 1 illustration modified for use of wire shaft-lock members that are perpendicular instead of parallel to the base plate;

FIG. 8 is a cutaway side view of an embodiment with a parallel-pivotal latch plate attached to a door frame;

FIG. 9 is a cutaway front view of the FIG. 8 illustration;

FIG. 10 is a cutaway front view of the FIGS. 8–9 illustrations with the latch plate rotated parallel to an open mode;

DESCRIPTION OF THE PREFERRED EMBODIMENT

Figure 1:
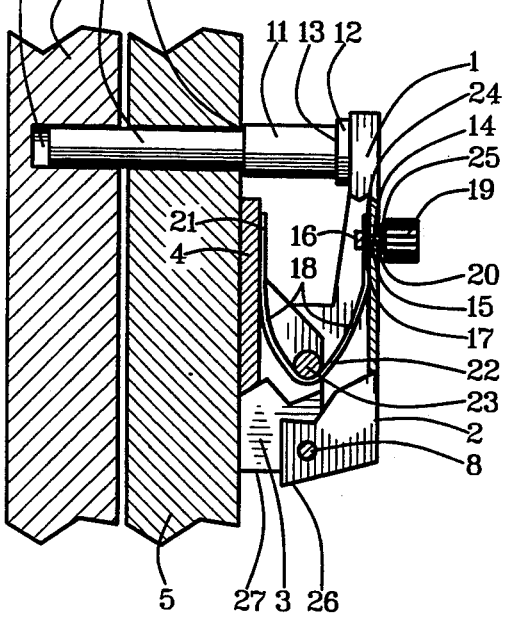
FIG. 1 is a cutaway side view of a basic embodiment with a perpendicularly pivotal latch plate and with a base plate attached to a sliding door. A sliding-door lock pin and the latch plate are in a locked mode.
Figure 2:
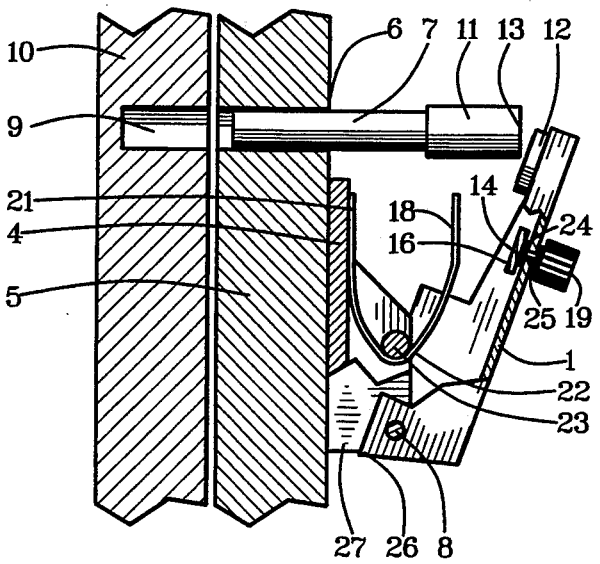
FIG. 2 is the FIG. 1 illustration pivoted perpendicularly to an unlocked mode.
Figure 3:
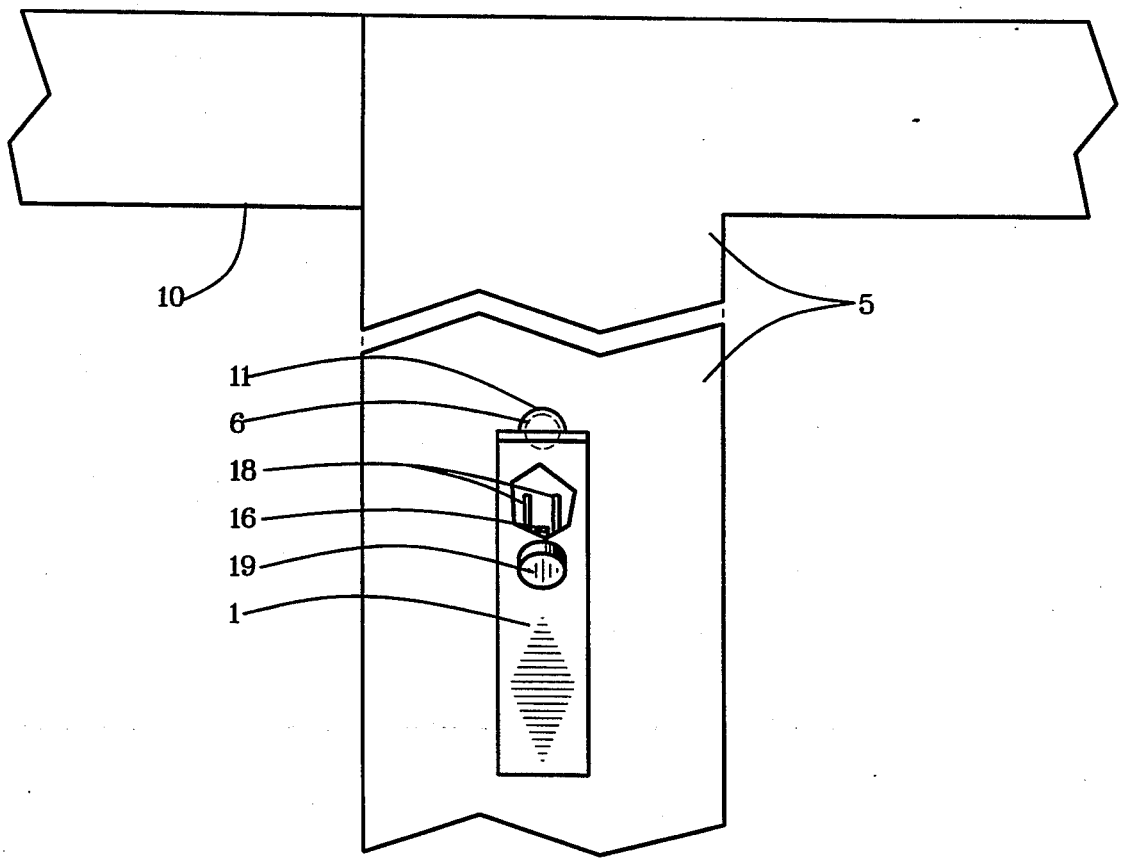
FIG. 3 is a front view of the FIG. 2 illustration on a door frame.
Figure 11:
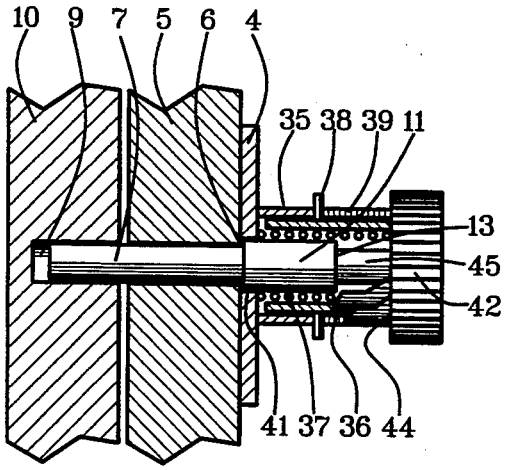
FIG. 11 is a cutaway side view of a modification of the FIGS. 8–10 illustrations with a lock pin attached centrally to a parallel-rotational latch plate. The base plate is attached to a sliding-door frame with adhesive.
Figure 12:
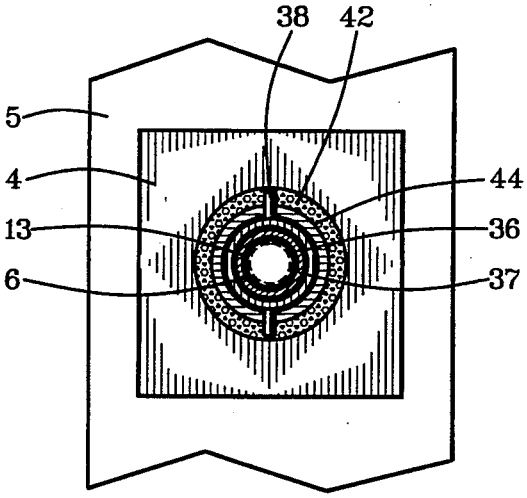
FIG. 12 is a cutaway front view of the FIG. 11 illustration in locked mode.
Figure 13:
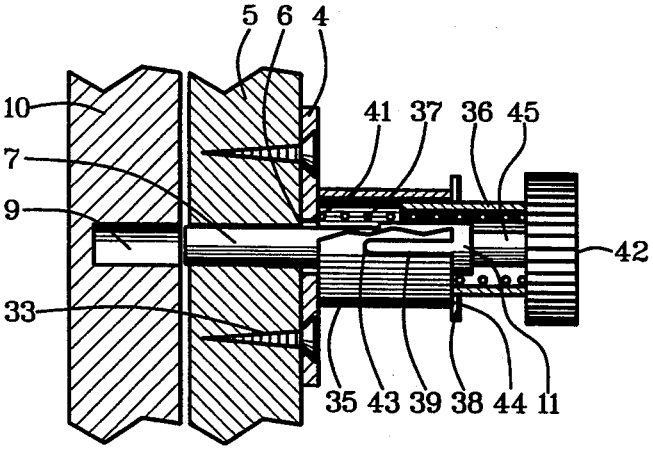
FIG. 13 is the FIG. 11 illustration with the latch plate rotated to an unlocked mode and with screw attachment of the base plate to the sliding-door frame.
Figure 14:
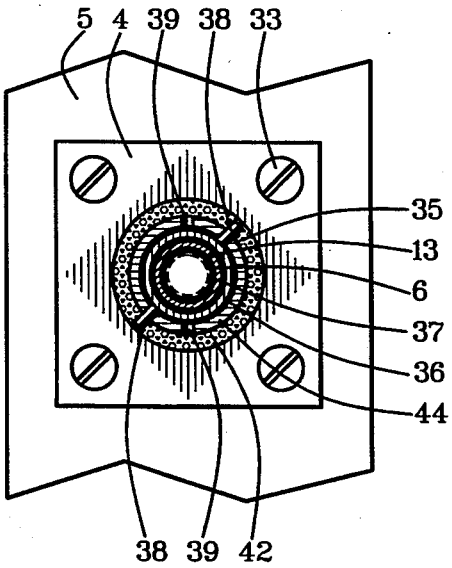
FIG. 14 is a cutaway front view of the FIG. 13 illustration.

Reference is made first to FIGS. 1–3. A latch plate 1 has a pivotal end 2 attached to a pivotal end 3 of a base plate 4. The latch plate 1 pivots perpendicularly to a door frame 5 to which the base plate 4 is attachable proximate a lock-pin orifice 6 in which a sliding-door lock pin 7 is positioned.

In this perpendicularly pivotal embodiment, the latch plate 1 can be made to pivot perpendicularly to the door frame 5 on a latch axle 8 or other type of pivotal attachment of the latch plate 1 to the base plate 4. The lock pin 7 is inserted through the lock-pin orifice 6 in the door frame 5 and into matching lock-pin orifice 9 in a second door flame 10 to lock the two door flames 5 and 10 together. For some sliding doors, however, either the door frame 5 or the second door frame 10 is a rigid wall or other rigid structure to which a sliding door is fastened with the lock pin 7 for locking the door. The door flame 5, therefore, is intended to be whichever type of door frame in which a lock-pin orifice 6 exists. Also, sliding doors are intended to include any type of sliding closure such as sliding windows.

Lock pins 7 usually have a lock-pin flange 11 to prevent excessive entry of the lock pin 7 into the matching lock-pin orifice 9 in the second door frame 10 or other sliding-door element. For either type of structure, the base plate 4 is attached to the door frame 5 at a position proximate the lock-pin orifice 6 which centers a latch-plate pad 12 or other latch-plate contact surface on an outside end 13 of the lock pin 7. For lock pins 7 having a lock-pin flange 11, the outside end 13 of the lock pin 7 is the outside end of the lock-pin flange 11.

The latch plate 1 can be prevented from pivoting away from contact with the lock pin 7 or lock-pin flange 11 and thereby maintained in contact with the outside end 13 of the lock pin 7 with a latch shaft 14. The latch shaft 14 is pivotal in a latch-shaft orifice 15 in the latch plate 1. The latch shaft 14 has at least one and usually two lock arms 16 that are extended perpendicularly from a latch end 17 of the latch shaft 14. Locking the latch plate 1 in contact with the lock pin 7 is accomplished by rotation of the latch shaft 14 to a circumferential position in which at least one lock arm 16 is in contact with an opposite side of a shaft-lock member 18 from the latch plate 1. The latch shaft 14 can be rotated with a latch knob 19 on a control end 20 of the latch shaft 14. The one or more lock arms 16 are parallel to the shaft-lock member 18 in unlocked mode and perpendicular to the shaft-lock member 18 in locked mode.

The shaft-lock member 18 can have a variety of forms. In the FIG. 1 embodiment, the shaft-lock member 18 is a rod or wire that has a base end 21 attached to the base plate 4. A central section 22 is positioned in rigid contact with a base rod 23 that is attached rigidly to an extension of the base plate 4. Rigid contact of the shaft-lock member 18 in a wire or rod form can include wrapping it around the base rod 23. A lock end of the shaft-lock member 18 is then curved back to a position proximate the latch-shaft orifice 15 where the lock arm(s) 16 can be located on the latch shaft 14 to a locked position. Usually there are two juxtaposed rod or wire shaft-lock members 18 in order to allow positioning of lock arms 16 between them for unlocked mode and to be positioned perpendicularly to them for locked mode. An inside flange 24 can be employed to maintain the latch shaft 14 in the latch-shaft orifice 15 and to maintain the lock arms 16 at a desired distance from the latch plate 1 to allow entry of the shaft-lock members 18 between the lock arms 16 and the base plate 1 when the latch shaft 14 is rotated to a locked position by rotation of latch knob 19. Preferably the latch shaft 14 is a T-shaped member with the lock arms 16 extended as arms of the T-shape and with the latch knob 19 attached to a terminal end of a leg of the T-shape. An outside flange 25 can be employed to provide a rotational bearing surface.

A butt end 26 of the latch plate 1 can be positioned to prevent excessive pivotal travel of the latch plate 1 on the latch axle 8 when it contacts a butt end 27 of the base plate 4. This keeps the latch plate 1 in a desired pivotal position when the latch shaft 14 is rotated to an unlocked mode.

Referring to FIGS. 4–6, a shaft-lock plate 28 can be employed in lieu of the wire or rod form of shaft-lock member 18. The shaft-lock plate 28 can be shaped similar to a section of either square tubing, channel iron or angle iron. A shape similar to square tubing resting on a side is the shaft-lock plate 28 shown in FIGS. 4–6. In FIGS. 4–5, walls 29 of the square-tubing form are parallel to the latch plate 1 and the base plate 4. In FIG. 6, the walls 29 are perpendicular to the latch plate 1 and the base plate 4. A base end 30 of the shaft-lock plate 28 is attached to the base plate 4, leaving a lock end 31 as a top wall through which is provided a latch-shaft orifice 32 for insertion of the latch shaft 14 and the lock arms 16. The latch-shaft orifice 32 is rectangular to allow entry of oppositely disposed lock arms 16. It also prevents removal of the lock arms 16 when the latch shaft 14 is rotated to position with the lock arms 16 circumferentially rotated from alignment with the rectangular latch-shaft orifice 32.

Fastener screws 33 are illustrated in fastening relationship between the base plate 4 and the door frame 5. This is optional to adhesive attachment illustrated in FIGS. 1–3. Adhesive attachment is preferred because it is easier, quicker, less expensive and adequate for the physical conditions involved. There is only minimal separation pressure involved. Avoiding alteration of the frame 5 is more important than a stronger fastener means such as the screws 33.

Referring to FIG. 7, a shaft-lock rod 34 can be employed as an alternative to shaft-lock member 18. The shaft-lock rod 34 can have a base end attached to the base plate 4 and a lock end at a position of lockable contact with the lock arms 16 of the latch shaft 14. Like the shaft-lock plate 28, the shaft-lock rod 34 can have ends extended to form a square, a U-shape similar to channel iron or an L-shape similar to angle iron. Also like shaft-lock plate 28, the shaft-lock rod 34 can be positioned either parallel or perpendicular to the base plate 4. FIG. 7 illustrates positioning of the shaft-lock rod 34 perpendicular to the base plate 4. Two shaft-lock rods 34 can be juxtaposed as shown in FIG. 7 to allow entry of lock arms 16 between them in an unlocked mode. The latch shaft 14 then can be rotated to position the lock arms 16 under a lock end of the shaft-lock rod 34 for a locked mode. The shaft-lock rods 34 can be braced, attached together or variously supported. Alternatively also, the shaft-lock rods 34 can be constructed of square or rectangular rods such that, in effect, they are juxtaposed shaft-lock plates with a space between them instead of a latch-shaft orifice 32 for insertion of the lock arms 16. A shaft-lock member 18, therefore, can be constructed in a variety of forms. Shaft-lock rods 34 differ from lock-shaft member 18 illustrated in FIG. 1 by not being positioned in rigid contact with a base rod 23, by being positional perpendicular to the base plate 4, by having alternative construction from angled rods or plates and by being extendible in rectangular forms.

Referring to FIGS. 8–10, in a parallel-pivotal embodiment, the latch plate 1 is pivotal in a plane parallel to a plane of the base plate 4. This is accomplished by positioning the latch axle 8 shown in FIGS. 1–2 and 4 perpendicular instead of parallel to the base plate 4 and the latch plate 1. A base-plate cylinder 35 is extended perpendicularly from a latch-plate side of the base plate 4. A latch-plate shaft 36 is extended perpendicularly from the latch plate 1 and inserted into the base-plate cylinder 35. An outside periphery of the latch-plate shaft 36 is slidable circumferentially and linearly against an inside periphery of the base-plate cylinder 35. The latch-plate shaft 36 also is cylindrical with a hollow interior. A latch spring 37 within the latch-plate shaft 36 is extended in contractive relationship between the latch plate 1 and the base plate 4. With the latch plate 1 able to pivot or swivel parallel to the base plate 4, the latch plate 1 is pivotal parallel to the door frame 5 and to the outside end 13 of the lock pin 7 or a lock-pin flange 11 extended from the lock pin 7. With the lock pin 7 in a locked mode in the lock-pin orifice 6 and in the matching lock-pin orifice 9, the latch plate 1 can be pivoted to a position of contact with the lock pin 7 to retain the lock pin 7 in the locked mode with contraction pressure of the latch spring 37. For an unlocked mode, the latch plate 1 is pivoted to a position of non-contact with the lock pin 7, such that the lock pin 7 can be removed from the matching lock-pin orifice 9.

The latch plate 1 can be held in a rotational position in contact with the lock pin 7 by at least one location pin 38 extended perpendicularly from the latch-plate shaft 36 into at least one matching location-pin serration 39 in a lock end 40 of the base-plate cylinder 35. To rotate the latch plate 1 to an unlocked position, the base plate 1 is pulled against contraction pressure of the latch spring 37 to remove the location pin 38 from the location-pin serration 39. Then the latch plate 1 can be rotated to a circumferential position in which the location pin 38 is in contact with the lock end 40 of the base-plate cylinder 35 to allow parallel rotation. Illustrated in FIGS. 9–14 are preferably two location pins 38 that are oppositely disposed.

Referring to FIGS. 11–14, a base-plate lock-pin orifice 41 can be provided for insertion of the lock pin 7 or an extension as a lock-pin flange 11 into the latch-plate shaft 36 where the lock pin 7 can be attached to the latch plate 1 structured as knob latch plate 42. In this embodiment, the base-plate cylinder 35 and the latch-plate shaft 36 have sufficient length for removal of the lock pin 7 from the matching lock-pin orifice 9 by pulling the knob latch plate 42 a designed distance from the base plate 4 and door frame 5. The location-pin serrations 39 also are longer or deeper in the base-plate cylinder 35. In a locked mode, the location pins 38 are at a bottom end 43 of the location-pin serrations 39. In an unlocked mode, the location pins 38 are rotated by rotation of the knob latch plate 42 to a position where the location pins 38 are resting against an unlocked position 44 on an unlock end of the base-plate cylinder 35.

In order to accommodate different sizes and lengths of lock pins 7 and lock-pin flanges 11, the components of this embodiment can be made large enough to accept the largest lock pins 7 and lock-pin flanges 11 on the market. An adaptor 45 can be used to span any space between an inside surface of the knob latch plate 42 and an outside end 13 of a lock pin 7. Alternatively, this embodiment can be constructed in optimum sizes for particular lock pins 7 which can be constructed and marketed with the lock pins 7 attached to or to be attachable later to the knob latch plate 42. Then all that is required is adherence or fastening of the base plate 4 to a door frame 5 with a lock-pin orifice 6 concentric with the base-plate lock-pin orifice 41.

A new and useful lock-pin latch for sliding doors having been described, all such modifications, adaptations, substitutions of equivalents, mathematical possibilities of combinations of parts, applications and forms thereof as described by and foreseeable within the following claims are included in this invention.

I claim:

1. A lock-pin latch comprising:

a latch plate having a pivotal end attached pivotally to a pivotal end of a base plate;

a latch-shaft orifice in the latch plate intermediate the pivotal end and a lock-pin end of the latch plate;

a latch shaft positioned pivotally in the latch-shaft orifice;

at least one lock arm extended perpendicularly from a latch end of the latch shaft; and a shaft-lock member comprising at least one rod having a base end attached to the base plate, a central section in rigid contact with a base rod that is attached to the base plate and a lock end extended parallel to the base plate at a position of lockable contact with the lock arm of the latch shaft.

2. A lock-pin latch comprising:

a latch plate having a pivotal end attached pivotally to a pivotal end of a base plate;

a latch-shaft orifice in the latch plate intermediate the pivotal end and a lock-pin end of the latch plate;

a latch shaft positioned pivotally in the latch-shaft orifice;

at least one lock arm extended perpendicularly from a latch end of the latch shaft; and a shaft-lock member comprising at least one rod having a base end attached to the base plate and a lock end at a position of lockable contact with the lock arm of the latch shaft.

3. A lock-pin latch as described in claim 1 wherein:

the latch shaft is T-shaped with a knob attachable to a control end on a leg of the T-shaped latch shaft and having two lock arms extended in oppositely disposed relationship.

4. A lock-pin latch comprising:

a latch plate having a pivotal end attached pivotally to a pivotal end of a base plate;

a latch-shaft orifice in the latch plate intermediate the pivotal end and a lock-pin end of the latch plate;

a latch shaft positioned pivotally in the latch-shaft orifice;

at least one lock arm extended perpendicularly from a latch end of the latch shaft;

a shaft-lock member comprising a plate having a base end attached to the base plate and a lock end extended parallel to the base plate;

a lock-shaft orifice sized and shaped to receive the latch shaft and the two lock arms of the T-shaped latch shaft with the latch shaft rotated to a circumferential position in which the two lock arms are in line with lock-arm extensions of the lock-shaft orifice;

an inside flange on the latch shaft proximate an inside surface of latch plate; and an outside flange on the latch shaft proximate an outside surface of the latch plate.

5. A lock-pin latch as described in claim 1 and further comprising:

an inside flange on the latch shaft proximate an inside surface of latch plate; and an outside flange on the latch shaft proximate an outside surface of the latch plate.

6. A lock-pin latch as described in claim 1 wherein: the base plate is attachable to a door frame with adhesive material between an attachment surface of the base plate and a surface of the door frame adjacent to a lock-pin orifice.

* * * * *